United States Patent [19]

Kawamata

[11] 3,966,079

[45] June 29, 1976

[54] SEAL FOR CAN OR LIKE CONTAINER

[75] Inventor: Kiyoshi Kawamata, Ohmiya, Japan

[73] Assignee: Nihon Seikan Kabushiki Kaisha, Japan

[22] Filed: June 6, 1975

[21] Appl. No.: 584,602

Related U.S. Application Data

[62] Division of Ser. No. 428,735, Dec. 27, 1973.

[52] U.S. Cl. ..... 220/266; 220/359

[51] Int. Cl.[2] ..... B65D 41/32

[58] Field of Search ..... 220/260, 265, 266, 359; 229/7 R, 51 AS; 215/258

[56] References Cited

UNITED STATES PATENTS 3,292,828 12/1966 Stuart ..... 220/260 X 3,516,852 6/1970 Janssen et al. ..... 220/260 X

*Primary Examiner*—George T. Hall

*Attorney, Agent, or Firm*—Wenderoth, Lind & Ponack

[57] ABSTRACT

A sealing device adapted to be removably attached by adhesive means to a can or the like, said device being of sufficient size and shape to cover and seal openings in said container. The device consists essentially of two elements, a single piece of adhesive-backed sealing material, separated into two parts by a perforation, placed over the opening of the container and a finger catch element for separating the two parts of the sealing material along the perforation and removing that part of the sealing material which covers the opening into the container.

2 Claims, 8 Drawing Figures

SEAL FOR CAN OR LIKE CONTAINER

This is a division of application Ser. No. 428,735, filed Dec. 27, 1973.

BACKGROUND OF THE INVENTION

This invention relates to a seal which is removably attached by adhesive means to a cover of a can or a like container in such a manner so as to tightly cover openings therein.

Various prior devices have been known for this purpose. One prior device providing easy means of a can opening comprises a finger-catch means rigidly secured to the cover of a can having a series of perforations along the periphery of the cover. In that case, the finger-catch means is securely attached to the cover near the peripheral perforated line; pulling this means detaches the cover therewith from the can body.

According to another prior device, two parallel lines of perforations are provided along the peripheral upper end portion of the can body. In that case, the can is opened by winding the perforated portion by separate winding means to sever the can body into two parts.

According to still further prior art, a heat-contracted sealing material is used to cover a bottle cork to seal the bottle tightly. In this case, the cork is removed from the bottle by detaching the sealing material therefrom.

However, these prior arts present disadvantages since in the first two cases, choice of material for making the can body or cover is very restricted and the manufacturing process becomes complicated, thus unavoidably slowing down the manufacturing speed of cans. In the last case, processing steps after filling the contents into bottles must be increased.

In order to eliminate these disadvantages, another prior invention provides an airtight film material of a strong nature adapted to cover an opening provided in the cover. This may have improvements over all the earlier arts since it permits an easier manner of manufacturing cans and provides for fewer treatments after filling the contents into cans. In this case, a can can be easily opened simply by detaching the film material therefrom. However, the very easiness with which the can is opened does harm to the sealing function.

The present invention provides an improvement over all the prior arts to overcome the disadvantages as hereinafter described.

BRIEF SUMMARY OF THE INVENTION

This invention relates to a seal made of airtight material or laminated film material of a strong nature. This seal is removably attached by adhesive means to the cover of a can or like container in such a manner so as to tightly cover openings provided in suitable positions in the cover.

One object of the invention is to provide a seal formed in a piece of sealing material and having sufficient size and shape to cover openings provided in the cover, comprising, on the lower side thereof, a first area free from adhesive material and a second area entirely coated with adhesive material, said first area being provided by a piece cut out of the sealing material with one side remaining from which the piece is bent downwardly to provide an underlapped portion, and, on the upper side, a series of perforations provided on opposite sides of the edge formed by bending said piece.

Another object is to provide a seal having said first area provided slightly inwardly from one end of the seal.

Still another object is to provide a seal having, on the lower side thereof, a given length of tape attached by adhesive means to said first area and, on the upper side of the material, a series of perforations which sever into two parts when the tape is pulled by a finger.

A further object is to provide a seal in which a series of perforations and one or two cutouts are provided for severing the material into two parts.

A still further object is to provide a seal in which one or two cutouts only are provided.

Other objects can be seen from the specification which will be described hereinafter.

DETAILED DESCRIPTION OF THE INVENTION

This invention will be further described by way of preferred embodiments with reference to the accompanying drawings.

Figure 8:
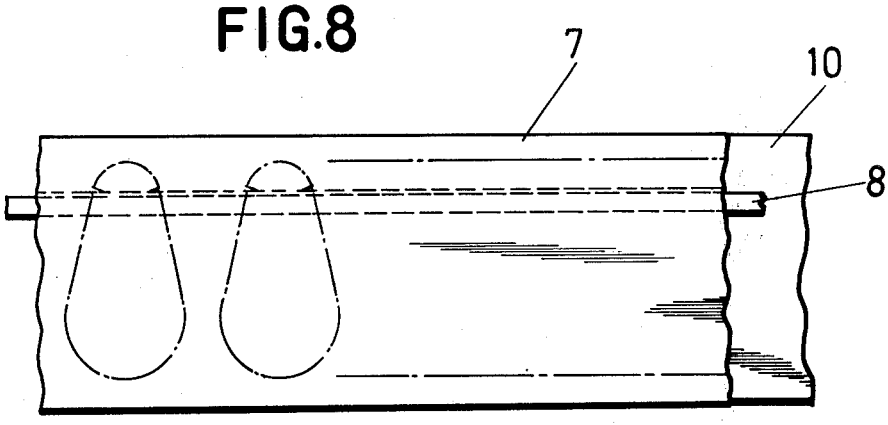
FIG. 8 is a plan view of a number of seals yet to be stamped out of sealing materials.

A sealing device according to the present invention is made of an airtight material of aluminum 7 formed like a sheet. Referring first to FIG. 8, the aluminum material 7 includes a sheet of synthetic resin tape material 8 of a substantially smaller width than the aluminum material 7 which is attached by adhesive means to the underside of the material 7 as indicated. The aluminum material 7 is, on the lower side thereof, entirely coated with adhesive material, except for the underside of tape 8 and is removably attached to a base paperboard 10. The material 7 thus combined is patterned into a desired shape and cut out in pieces of seals 3 to include a portion having a series of perforations 5 for severing the sealing device 3 into two pieces, one or two cutout portions **6, 6*a* on either side of the perforations 5 for each severance of the sealing device, and one or two extended portions 8*a*, 8*b* of the synthetic resin tape material forming finger-catch tape elements 8, said perforations 5 being in the aluminum material 7 along the edge 8*c* of the tape element 8. The seal thus obtained is detached from the paperboard 10 and is then applied to the cover 1 in such a manner as to cover an opening 2 and an air hole 9.**

Figure 1:
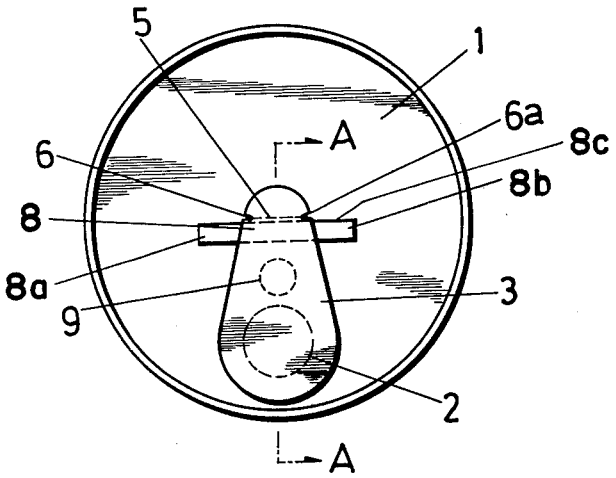
FIG. 1 is a plan view of a seal as one preferred embodiment attached to a cover of a can.
Figure 2:
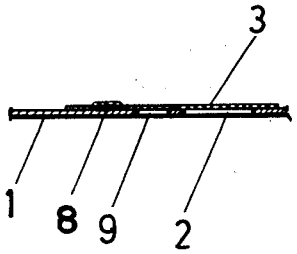
FIG. 2 is a sectional view taken along the line A — A in FIG. 1.
Figure 3:
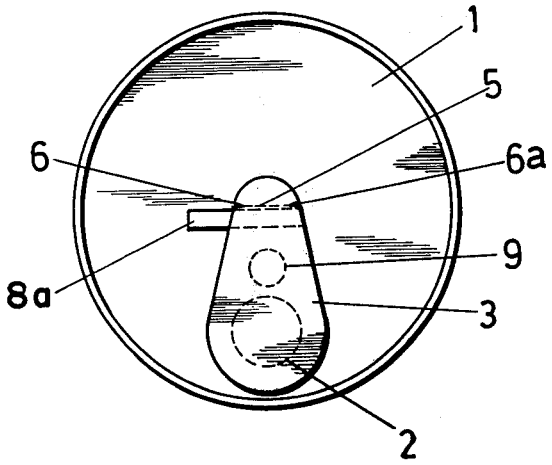
FIG. 3 is a plan view of another seal.
Figure 4:
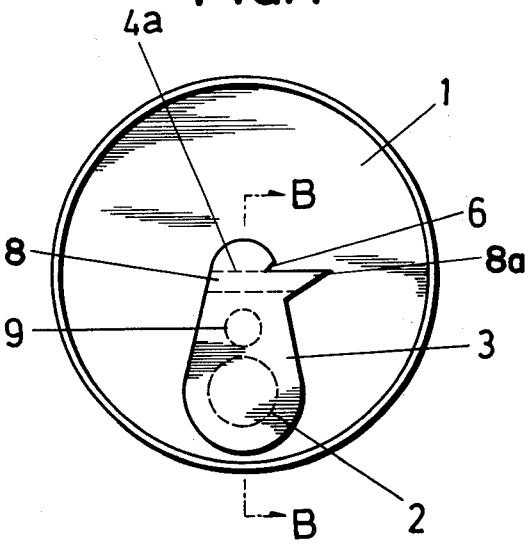
FIG. 4 is a plan view of another seal.
Figure 5:
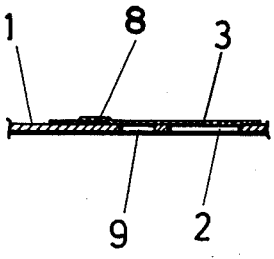
FIG. 5 is a sectional view taken along the line B — B in FIG. 4.

FIGS. 1 and 2 show one embodiment of the invention in which two extended portions **8*a*, 8*b* of the finger-catch element 8 and two cutouts 6, 6*a* are provided. In FIG. 3, one extended portion 8*a* and two cutouts 6, 6*a* are provided. In FIGS. 4 and 5, one extended portion 8*a* and one cutout 6 are provided. In the embodiments of FIGS. 4 and 5, the extended portion 8*a* is formed to include the aluminum element 7 and the syntehtic resin tape element 8 which are combined and cut out together. In the embodiments described above, the extended portion or portions 8***a*, 8*b* serve as finger-catch means, by which the sealing device 3 can be detached from the cover 1 as it is severed into two parts at the cutout or cutouts 6, 6*a*, along the perforated line 5, in which case one of said two parts is completely detached from the cover 1 while the other remains thereon, or without the line 5, in which case the entire sealing device 3 is removed from the cover 1.

In FIG. 1, two tape elements 8*a*, 8*b* are used as finger-catch means, but one element 8*a* or 8*b* as shown in FIGS. 3 and 4 may serve the purpose. There is provided a perforated portion 5 from which the sealing device 3 is severed into two parts, but one or two cutouts 6*a*, 6*b* only may be provided instead, and the smaller part which remains on the cover may be of smaller width than indicated.

A combination of the cutout portion and the perforated portion can ensure the severance of the sealing device 3 better. Anyway, the importance is in the easy severance of the alumimum element into two parts when the finger-catch element 8 is pulled. The finger-catch element 8 may be made of thread instead of the tape element of synthetic resin described above.

Figure 6:
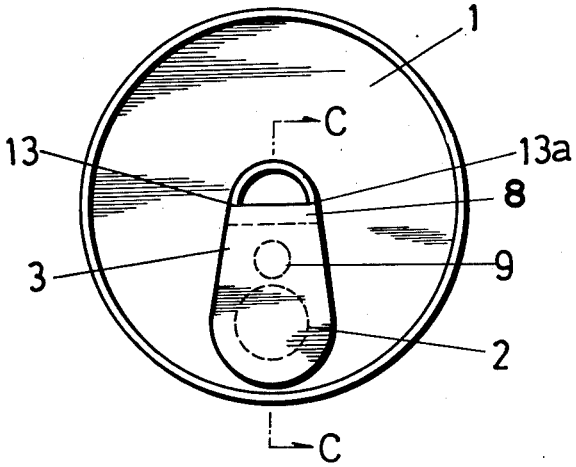
FIG. 6 is a plan view of another seal.
Figure 7:
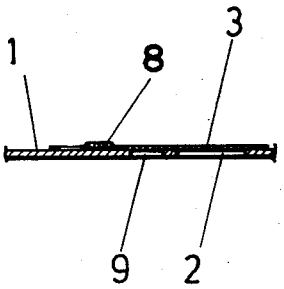
FIG. 7 is a sectional view taken along the line C — C in FIG. 6.

Referring now to FIGS. 6 and 7, another preferred embodiment of the invention will be described.

The sealing device 3 has a semicircular piece 12 cut out of one side thereof, semicircular piece 12 being stamped out in such a manner as to have one side left integral with the sealing device 3. The piece thus obtained is bent downwardly to provide an underlapped portion beneath the sealing device 3. A series of perforations 13, 13*a* for severing the sealing device into two parts extends from the edge formed by bending said piece downwardly. The underlapped portion is free from adhesive material and serves as a finger-catch means 8. In the figures, there are also an air hole 2 and a hole 9 from which the contents of the container are removed.

In all the embodiments described heretofore, the aluminum element may be made of synthetic resin material laminated therewith. All the embodiments are used as covers for openings in metallic cans or containers and cans or containers of synthetic resin or paper materials as well.

When it is desired to cover an opening in a can, a seal is removed from the paperboard and applied over the openings so that it may be sealed thereby. When the seal is removed from the can, it is caught by the overlapped portion or tape element and raised by the fingers so that the seal is severed into two parts, the smaller part of which remains on the cover. As described above, the two component parts ensure the sealing function while the presence of the non-adhesive area permits an easy detachment of the seal from the cover.

I claim:

1. A sealing device for covering an opening in a container, comprising:

adhesive-backed sealing material for covering said opening and adhering to said container, said sealing material having a first portion and a second portion separated by a straight perforated line, said first portion being removable along said perforation to completely uncover said opening, and said second portion remaining on said container after said first portion is removed; and finger catch means attached underneath said first portion near the perforation for separating the two portions of said sealing material along the perforation and for removing said first portion from the container.

2. A sealing device as claimed in claim 1, wherein:

said finger catch means comprises a cut-out section cut from said second portion of said sealing material and having an edge integral with said first portion, said cut-out section being folded underneath said first portion along said integral edge when said sealing device is in its operative position over an opening in a container; and wherein said perforation extends outward from the hole left by said cutaway section through the second portion to the edges of said sealing material whereby lifting the integral edge will cause the perforation to break, will separate said first and second portions, and will remove said first portion from said container.

* * * * *